US011585526B2

(12) United States Patent
Keppel

(10) Patent No.: US 11,585,526 B2
(45) Date of Patent: Feb. 21, 2023

(54) LIGHTING APPARATUS

(71) Applicant: Exton Capital Corp, Windsor, NJ (US)

(72) Inventor: Ron Keppel, Trenton, NJ (US)

(73) Assignee: Exton Capital Corp, Windsor, NJ (US)

( * ) Notice: Subject to any disclaimer, the term of this patent is extended or adjusted under 35 U.S.C. 154(b) by 0 days.

(21) Appl. No.: 17/124,979

(22) Filed: Dec. 17, 2020

(65) Prior Publication Data

US 2021/0180785 A1 Jun. 17, 2021

Related U.S. Application Data

(60) Provisional application No. 62/949,229, filed on Dec. 17, 2019.

(51) Int. Cl.

| | |
|---|---|
| ***F21V 33/00*** | (2006.01) |
| ***F21V 23/00*** | (2015.01) |
| ***F21V 5/04*** | (2006.01) |
| ***F21V 3/10*** | (2018.01) |
| ***F21V 21/02*** | (2006.01) |
| ***F21V 9/40*** | (2018.01) |
| *F21Y 115/10* | (2016.01) |

(52) U.S. Cl.

CPC ..... *F21V 33/0056* (2013.01); *F21V 3/10* (2018.02); *F21V 5/04* (2013.01); *F21V 9/40* (2018.02); *F21V 21/02* (2013.01); *F21V 23/003* (2013.01); *F21Y 2115/10* (2016.08)

(58) Field of Classification Search

CPC ..... F21V 33/0056; F21V 3/10; F21V 9/40; F21V 5/04; F21V 21/02; F21V 23/003; F21Y 2115/10

USPC ..... 362/235

See application file for complete search history.

(56) References Cited

U.S. PATENT DOCUMENTS

| | | | | |
|---|---|---|---|---|
| 2015/0036333 | A1* | 2/2015 | Tsuei | F21K 9/66 362/235 |
| 2015/0344736 | A1* | 12/2015 | Shin | C08K 3/10 362/217.02 |
| 2017/0294426 | A1* | 10/2017 | Uchida | G01S 17/04 |
| 2018/0020530 | A1* | 1/2018 | Scordato | F21V 33/0052 |

* cited by examiner

*Primary Examiner* — Britt D Hanley
*Assistant Examiner* — Hana S Featherly
(74) *Attorney, Agent, or Firm* — Offit Kurman, P.A.; Chintan A. Desai

(57) ABSTRACT

A lighting apparatus including an enclosure, a printed circuit board mounted to the enclosure, and an upwardly directed primary light emitting diode in electrical communication with the printed circuit board. The lighting apparatus additionally includes a power source for supplying electrical power to the printed circuit board. The lighting apparatus further includes a transparent dome situated atop the enclosure and covering the printed circuit board, wherein the transparent dome includes an optically unobstructed region in vertical alignment with the primary light emitting diode for passage of an upwardly directed light beam emitted from the primary light emitting diode when powered.

20 Claims, 4 Drawing Sheets

LIGHTING APPARATUS

CROSS-REFERENCE TO RELATED APPLICATION

This application claims the benefit under 35 U.S.C. § 119(e) to U.S. Provisional Application No. 62/949,229, filed Dec. 17, 2019, and entitled "Lighting Apparatus," the entire disclosure of which is hereby incorporated by reference for all purposes.

BACKGROUND OF THE DISCLOSURE

The exemplary embodiments of the subject disclosure relate generally to a lighting apparatus and, more specifically, to a lighting apparatus for use in connection with communication/emergency equipment.

In the emergency/information communication device industry, manufacturers typically provide enclosures or housings for their communication devices, e.g., telephones and intercoms. Included in the housings are illuminated beacons, typically blue in color, to provide a visual aid to enhance the public's awareness of the location of the telephone or intercom. Normally, the beacon is a glowing light source. However, such light sources are only effective when nothing is impeding or blocking the light, i.e., when the light is not obscured by vehicles, crowds, signage and miscellaneous objects.

BRIEF SUMMARY OF THE DISCLOSURE

In accordance with an exemplary embodiment there is provided a lighting apparatus including an enclosure, a printed circuit board mounted to the enclosure, and an upwardly directed primary light emitting diode in electrical communication with the printed circuit board. The lighting apparatus additionally includes a power source for supplying electrical power to the printed circuit board. The lighting apparatus further includes a transparent dome situated atop the enclosure and covering the printed circuit board, wherein the transparent dome includes an optically unobstructed region in vertical alignment with the primary light emitting diode for passage of an upwardly directed light beam emitted from the primary light emitting diode when powered.

According to an aspect, the lighting apparatus further includes a secondary light emitting diode in electrical communication with the printed circuit board. According to a further aspect, the secondary light emitting diode includes a plurality of secondary light emitting diodes mounted to the printed circuit board. According to a further aspect, the lighting apparatus further includes a housing mounted to the printed circuit board and housing the primary light emitting diode. According to a further aspect, the housing includes a focusing lens above the primary light emitting diode. According to a further aspect, the focusing lens is a plano-convex lens for focusing light emitted by the primary light emitting diode in a divergent manner.

According to an aspect, the dome includes inwardly sloped front and rear walls and inwardly sloped side walls. According to a further aspect, the dome includes a substantially horizontal top wall and the optically unobstructed region is situated substantially centrally in the top wall.

According to an aspect, the lighting apparatus further includes a colored translucent coating provided on one of an inside surface or an outside surface of the transparent dome. According to a further aspect, the lighting apparatus further includes a light diffusing coating provided on the other of the inside surface or the outside surface of the transparent dome. According to a further aspect, the top wall of the transparent dome is free of colored translucent coating and light diffusing coating at the optically unobstructed region.

According to an aspect, the optically unobstructed region is an aperture. According to a further aspect, the power source comprises one of a telephone or an intercom housed within the enclosure. According to a further aspect, the lighting apparatus further includes a mount for securing the lighting apparatus to a wall or a floor.

Other features and advantages of the subject disclosure will be apparent from the following more detailed description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
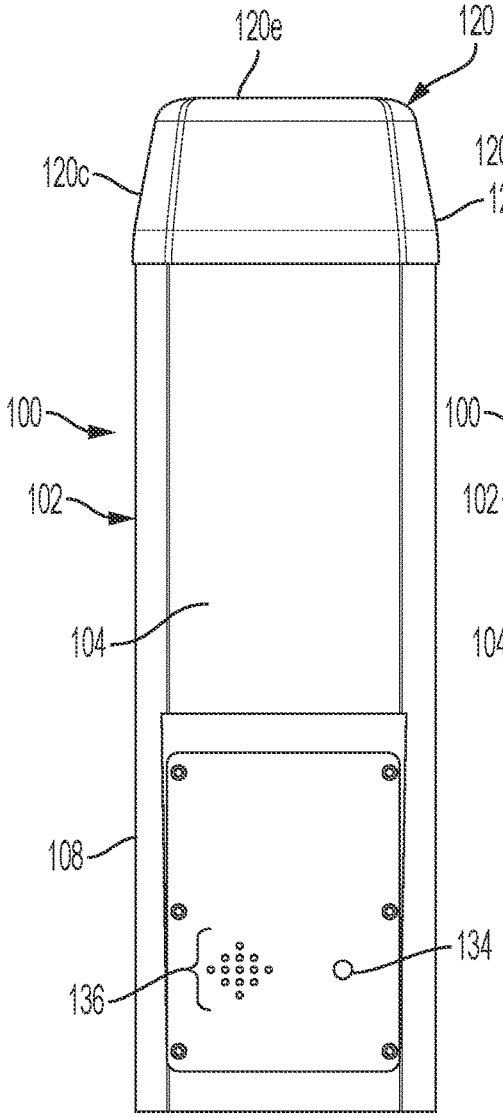
FIG. 1 is a front view of a lighting apparatus in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 2:
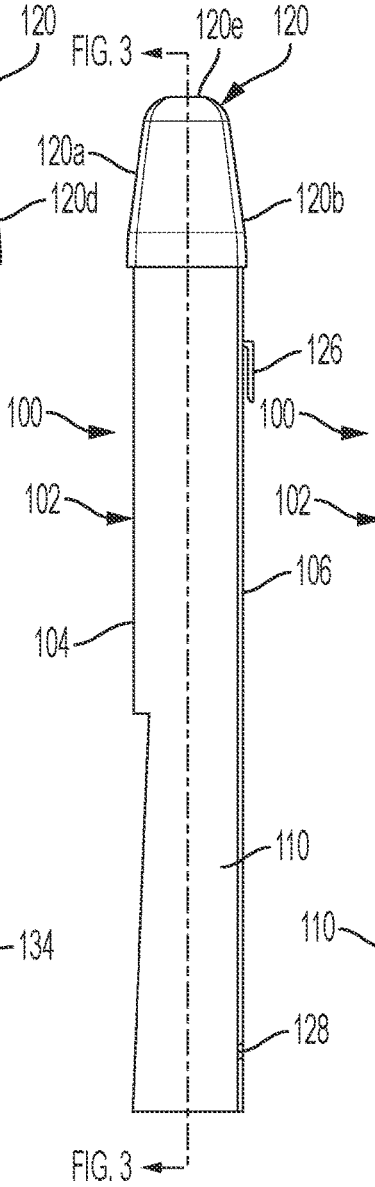
FIG. 2 is side view of the lighting apparatus of FIG. 1.
Figure 3:
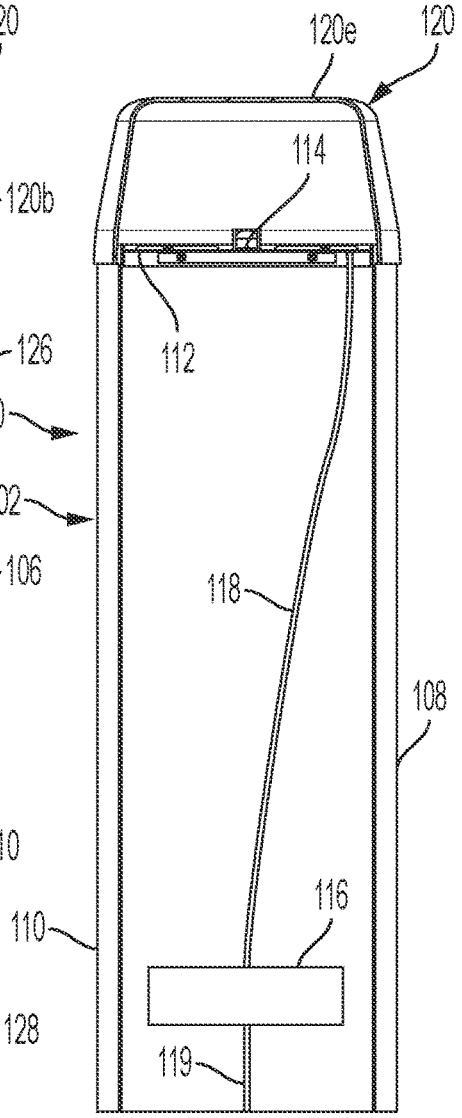
FIG. 3 is a cross-sectional view of the lighting apparatus taken along line III-III of FIG. 2.
Figure 4:
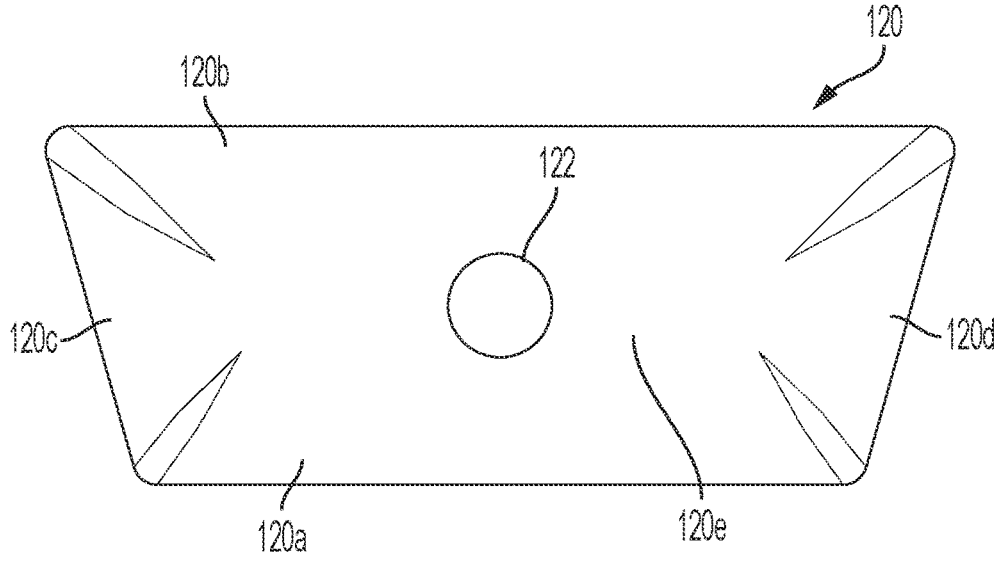
FIG. 4 is a top plan view of the lighting apparatus of FIG. 1.
Figure 5:
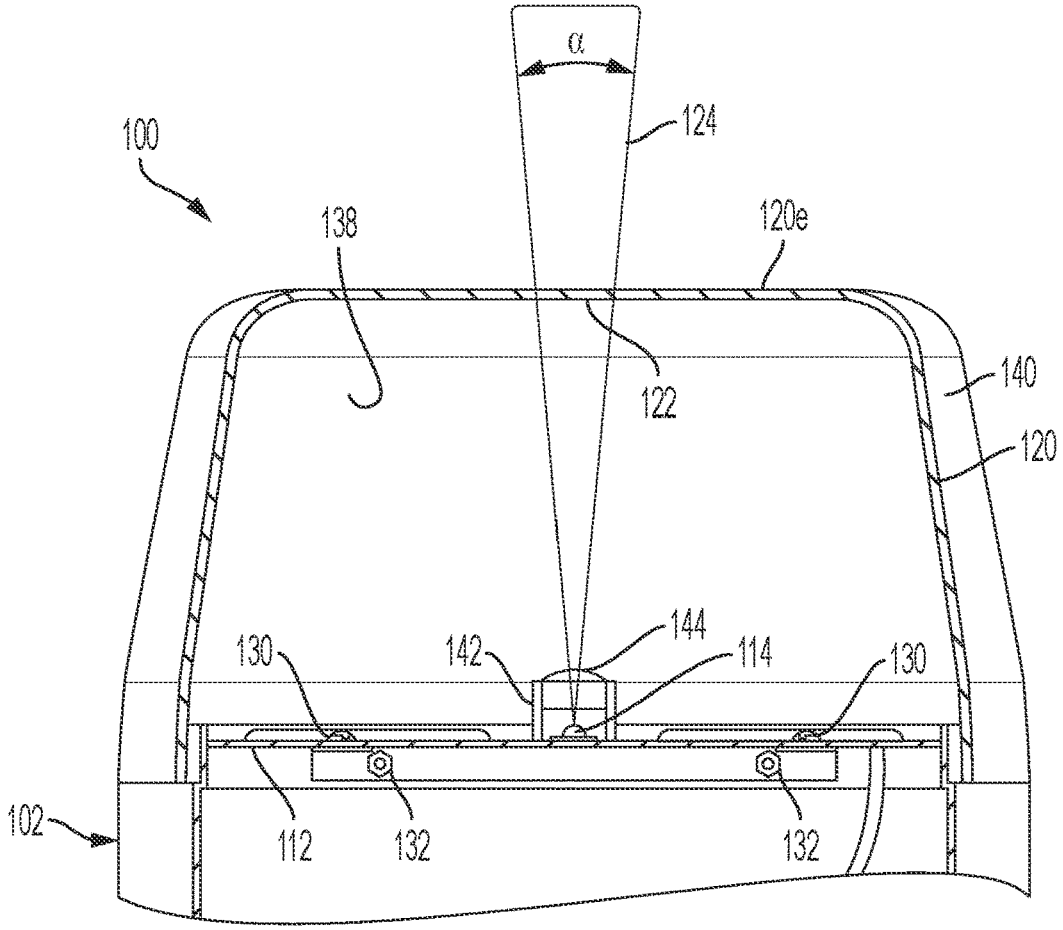
FIG. 5 is an enlarged cross-sectional view an upper portion of the lighting apparatus of FIG. 1 in an illuminated state.
Figure 6:
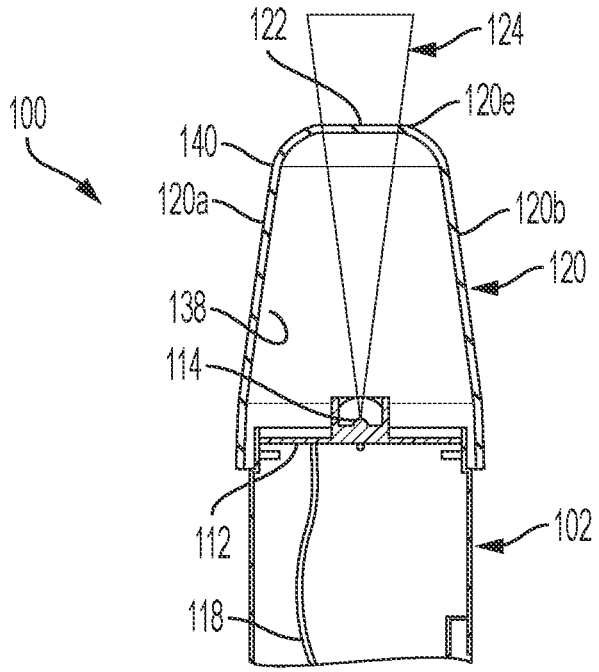
FIG. 6 is a side cross-sectional view of an upper portion of the lighting apparatus of FIG. 1 in an illuminated state.
Figure 7:
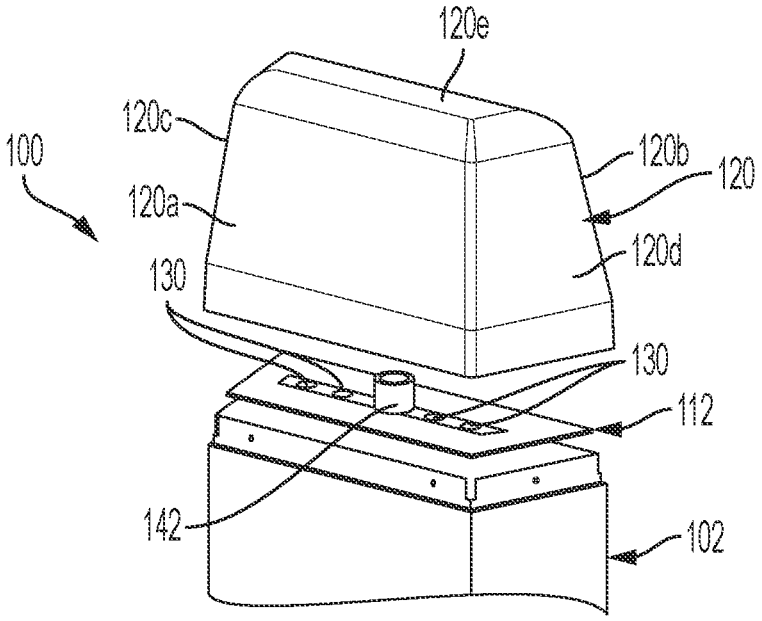
FIG. 7 is an exploded view of an upper portion of the lighting apparatus of FIG. 1.

Referring now to the drawings, FIGS. 1-3 and 5-7 illustrate a lighting apparatus 100 in accordance with an exemplary embodiment of the present disclosure. The lighting apparatus 100 comprises an enclosure 102 having a front wall 104, a rear wall 106 and side walls 108, 110. As shown in FIGS. 3, 5 and 6, the lighting apparatus includes a printed circuit board 112 provided in the enclosure and an upwardly directed primary light emitting diode 114 in electrical communication with the printed circuit board. FIG. 3 illustrates a power source 116 for supplying electrical power to the printed circuit board by wire(s) or cable 118. According to an aspect, the power source can be a telephone or an intercom, as described below. In addition, the lighting apparatus comprises a transparent dome 120 situated atop the enclosure and covering the printed circuit board, wherein the transparent dome includes an optically unobstructed region 122 (FIGS. 4-6) in vertical alignment with the primary light emitting diode for passage of an upwardly directed light beam 124 emitted from the primary light emitting diode when powered.

The enclosure 102 can be fabricated from any suitable rigid material such as plastic or metal. By way of example, but not limitation, the enclosure can be constructed of stainless steel and includes a mount or mounting structure 126 provided on the enclosure for securing the lighting apparatus e.g., to a wall or a floor. According to an exemplary embodiment, the enclosure is freestanding and mounted to bolts installed in the floor. According to another exemplary embodiment, the enclosure mounts to a wall. Pursuant to the latter embodiment, FIG. 2 illustrates that the mounting structure 126 can include, e.g., a clip positioned adjacent the top of the enclosure and at least one mounting hole 128 positioned adjacent the bottom of the enclosure.

The lighting apparatus further comprises a secondary light emitting diode 130 (FIGS. 7 and 8), described below, in electrical communication with the printed circuit board 112. Alternatively, according to another exemplary aspect, the lighting apparatus can include a plurality of upwardly directed secondary light emitting diodes mounted to the printed circuit board. The printed circuit board 112 supports and electrically connects the primary light emitting diode 114 and the secondary light emitting diode to the power source 116. In other words, the primary light emitting diode and the secondary light emitting diode are in electrical communication with the printed circuit board. The printed circuit board includes unillustrated holes for receiving fasteners 132 (FIG. 5) for securing the printed circuit board to the enclosure 102, and preferably includes an unillustrated fuse for safety purposes. The printed circuit board is mounted in substantially horizontal orientation in an upper region of the enclosure above the power source and beneath the transparent dome.

The upwardly directed primary light emitting diode 114 is a high output light emitting diode sufficient to provide a projecting light beam 124. The primary light emitting diode can be any light emitting diode suitable for its intended purpose. For instance, an exemplary primary light emitting diode is a blue light emitting diode part number XP-E2 available from Cree, Inc. which has a maximum light output of 283 lumens, a viewing angle of about 110°-135°, and a radiant flux at 350 mA between 450 mW-575 mW. The primary light emitting diode thus can handle higher wattage than the secondary light emitting diodes, discussed below, which in turn provides a brighter light source.

The power source 116 can be one of a telephone or an intercom housed within the enclosure. Exemplary telephones or intercoms suitable for the power source 116 are manufactured, e.g., by Emcom Systems, Inc. In the illustrated example, the power source is an intercom, including a communication button 134 and microphone/speaker apertures 136 which are shown in FIG. 1. The telephone or intercom provides the power and flash pattern for the primary light emitting diode 114 and the secondary light emitting diodes 130, and can be configured to control the beacon to be continuously or intermittently active. Typically, the power provided by the power source 116 to the printed circuit board 112 ranges from 12 VDC-24 VDC. It is understood that when a telephone or intercom is used as the power source the telephone or intercom is itself connected to an unillustrated AC power supply or DC power supply, e.g., a battery, via wire or cable 119 or a building's power supply lines. Effective wall and ceiling illumination can be achieved when the primary light emitting diode 114 operates on electrical currents of, e.g., 350 mA and 700 mA.

The dome 120 may be manufactured from any suitable rigid material including, without limitation, polycarbonate, and can be secured to the enclosure 102 by any suitable fasteners, e.g., screws, rivets, adhesives, and the like. The dome may be pre-fabricated to be a desired color. Alternatively, as described below, the dome can be clear, colored or uncolored, and/or coated with a colored translucent coating and/or a light diffusing coating.

In accordance with an exemplary embodiment, the dome includes inwardly sloped front and rear walls 120*a*, 120*b*, inwardly sloped side walls 120*c*, 120*d* and a substantially horizontal top wall 120*e*, wherein the optically unobstructed region is situated substantially centrally in the top wall. In other words, the dome can be, e.g., substantially pyramidal frustum shaped. According to an aspect, if the dome is manufactured to be clear and uncolored, a colored translucent coating, e.g., blue coating, can be provided on one of an inside surface 138 or an outside surface 140 of the dome (FIGS. 5 and 6). In addition, a light diffusing coating can be provided on the other of the inside surface and the outside surface of the dome. By way of example, but not limitation, a suitable colored translucent coating can be Tufcote LV HG high gloss polyurethane topcoat available from Axalta Coating Systems, LLC. Similarly, an exemplary light diffusing coating can be Chromafuse anti-hot spot optical coating available from Performance Coatings International Laboratories.

The optically unobstructed region 122 is a region in the top wall 120*e* of the transparent dome that is free of optical obstructions through which the upwardly projecting light beam 124 passes without experiencing optical influences. Optical obstructions can include any substances that hinder or influence unfettered passage of the upwardly projecting light beam including, without limitation, particles, films or coatings that block, reflect, refract and/or diffuse the light beam. In the illustrated example of FIG. 4, the top wall 120*e* of the transparent dome 120 is free of colored translucent coating and light diffusing coating at the optically unobstructed region 122 whereby the upwardly projecting light beam 124 may pass unhindered through the top wall.

In the alternative, the optically unobstructed region can be an aperture provided in the top wall 120*e* sized to permit unfettered passage of the upwardly projecting light beam 124. In any case, in order to achieve effective wall and ceiling illumination by the upwardly projecting light beam, the diameter of the optically unobstructed region 122 can range from about 20-30 mm, including 21, 22, 23, 24, 25, 26, 27, 28 and 29 mm.

By way of example, but not limitation, the lighting apparatus can include one or more strips 131 (FIGS. 7 and 8) of secondary light emitting diodes 130. An exemplary light emitting diode strip includes a blue light emitting diode strip, part number STN-BBLU-C3A-10C5M-12V, available from Super Bright LEDs, Inc., which has a maximum light output of 94 lumens per light emitting diode. The strip of secondary light emitting diodes 130 can be attached directly to the printed circuit board 112 and provides a beacon glow light. In addition, while the primary light emitting diode is preferably a single, stand-alone high output light emitting diode, it is also contemplated that one the secondary light emitting diodes 130 of the strip 131 of secondary light emitting diodes can serve as the primary light emitting diode for producing the upwardly projecting light beam 124 provided it can output lumens sufficient to generate an effective upwardly projecting light beam when focused by a focusing lens such as lens 144, discussed below.

Figure 8:
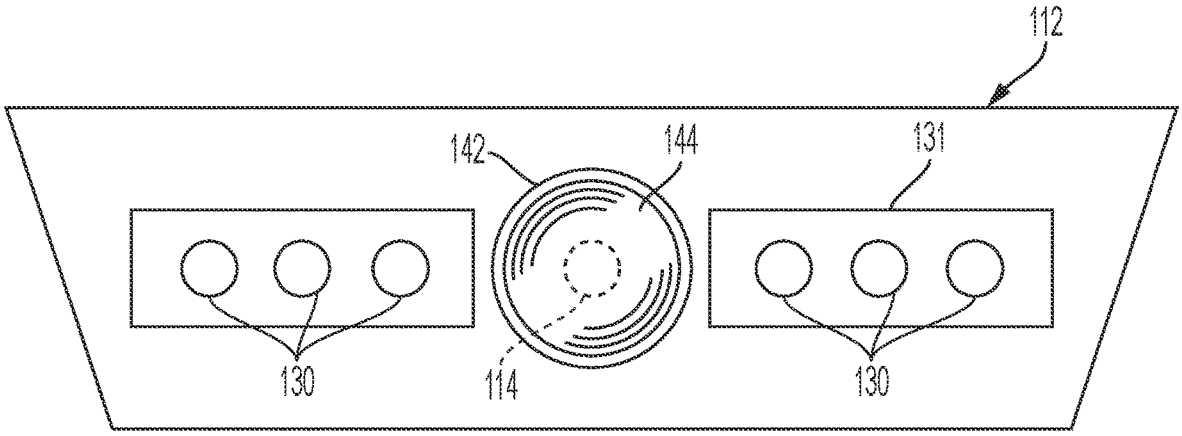
FIG. 8 is a top plan view of a printed circuit board of the lighting apparatus of FIG. 1.

As most clearly shown in FIGS. 5 and 8, the lighting apparatus 100 further comprises a housing such as a cylindrical housing 142 mounted to the printed circuit board 112 and housing the primary light emitting diode 114. The housing 142 is constructed and arranged to readily dissipate heat from the primary light emitting diode as excessive heat is detrimental to effective, long-lasting operation of a light emitting diode. The housing includes a focusing lens 144 situated above the primary light emitting diode. The focusing lens can form the entire top of the housing or a portion of the top of the housing. The focusing lens focuses light emitted by the primary light emitting diode whereby the primary light emitting diode emits light of greater focus than the secondary light emitting diode to form the projecting light beam 124. A focusing lens applicable to the subject embodiment can be a plano-convex lens available from Carclo Technical Plastics, for focusing the light emitted by the primary light emitting diode in a divergent manner, e.g., into a light beam 124 having an angle "a" of about 10°-17°, preferably about 11°-15° (FIG. 5).

In operation, the light beam 124 projects through the optically unobstructed region 122 in the top wall 120*e* of the dome, while the secondary light emitting diode(s) impart a glow to the dome. As the light beam 124 projects further from the primary light emitting diode 114, the light beam widens and casts bright light on the wall adjacent the lighting apparatus 100 and on the ceiling above the lighting apparatus.

It has been observed that with the lighting apparatus constructed as described herein, the projecting beam 124 can be seen on walls and ceilings as far as twenty feet above the top of the dome 120, depending on ambient light, as well as wall and ceiling textures. As such, the lighting apparatus according to the subject disclosure overcomes the disadvantages of conventional communication/emergency lighting devices equipped with only glowing beacons. That is, even in the presence of obstructions such as vehicles, crowds, signage and miscellaneous objects, the projecting light beam 124 can be seen by the public from considerable distances on the wall and ceiling above the lighting apparatus 100. In addition, the light that is projected from the top of the lighting apparatus 100 does not require any extra peripheral lighting equipment to be installed outside the enclosure 102 to illuminate the wall and ceiling above the lighting apparatus.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as disclosed above and defined by the claims.

I claim:

1. A lighting apparatus comprising:

an enclosure;

a printed circuit board mounted to the enclosure;

an upwardly directed primary light emitting diode in electrical communication with the printed circuit board;

a power source for supplying electrical power to the printed circuit board; and a transparent dome situated atop the enclosure and covering the printed circuit board, the transparent dome including:

a planar bottom surface perpendicular to an axis of the lighting apparatus, and an optically unobstructed region along a top surface opposite the planar bottom surface, the optically unobstructed region in vertical alignment with the primary light emitting diode for passage of an upwardly directed light beam emitted from the primary light emitting diode when powered, wherein the primary light emitting diode is positioned within the transparent dome between the top surface and the planar bottom surface.

2. The lighting apparatus of claim 1, further comprising a secondary light emitting diode in electrical communication with the printed circuit board.

3. The lighting apparatus of claim 1, further comprising a housing mounted to the printed circuit board and housing the primary light emitting diode.

4. The lighting apparatus of claim 3, wherein the printed circuit board has an upwardly facing surface with a surface area larger than a cross-sectional area of the housing.

5. The lighting apparatus of claim 1, wherein the housing includes a focusing lens situated above the primary light emitting diode.

6. The lighting apparatus of claim 5, wherein the focusing lens is a plano-convex lens for focusing light emitted by the primary light emitting diode in a divergent manner.

7. The lighting apparatus of claim 1, further comprising a plurality of upwardly directed secondary light emitting diodes mounted to the printed circuit board.

8. The lighting apparatus of claim 1, wherein the transparent dome comprises inwardly sloped front and rear walls.

9. The lighting apparatus of claim 8, wherein the transparent dome comprises inwardly sloped side walls.

10. The lighting apparatus of claim 9, wherein the transparent dome comprises a substantially horizontal top wall and the optically unobstructed region is situated substantially centrally in the substantially horizontal top wall.

11. The lighting apparatus of claim 1, further comprising a colored translucent coating provided on one of an inside surface or an outside surface of the transparent dome.

12. The lighting apparatus of claim 11, further comprising a light diffusing coating provided on the other of the inside surface or the outside surface of the transparent dome.

13. The lighting apparatus of claim 1, further comprising a light diffusing coating provided on an inside surface or an outside surface of the transparent dome.

14. The lighting apparatus of claim 1, wherein a top wall of the transparent dome is free of colored translucent coating and light diffusing coating at the optically unobstructed region.

15. The lighting apparatus of claim 1, wherein the optically unobstructed region is an aperture.

16. The lighting apparatus of claim 1, wherein the power source comprises one of a telephone or an intercom housed within the enclosure.

17. The lighting apparatus of claim 1, wherein the enclosure includes a mount for securing the lighting apparatus to a wall or a floor.

18. The lighting apparatus of claim 1, further comprising a plurality of upwardly directed secondary light emitting diodes directly mounted to the printed circuit board.

19. The lighting apparatus of claim 1, wherein the printed circuit board is sized and shaped such that the printed circuit board extends along an inner perimeter of the enclosure.

20. The lighting apparatus of claim 1, wherein the enclosure includes a substantially vertical front wall, a substantially vertical rear wall opposite the substantially vertical front wall, and a pair of diametrically opposed substantially vertical side walls.

* * * * *